US007021577B2

(12) United States Patent
Papajewski et al.

(10) Patent No.: US 7,021,577 B2
(45) Date of Patent: Apr. 4, 2006

(54) MULTI-ROLLER CRUSHER

(75) Inventors: Detlef Papajewski, Bochum (DE); Peter Schatz, Ennigerloh (DE)

(73) Assignee: Thyssenkrupp Fordertechnik GmbH, Essen (DE)

( * ) Notice: Subject to any disclaimer, the term of this patent is extended or adjusted under 35 U.S.C. 154(b) by 2 days.

(21) Appl. No.: 10/475,076

(22) PCT Filed: Apr. 3, 2002

(86) PCT No.: PCT/EP02/03666

§ 371 (c)(1),
(2), (4) Date: Oct. 14, 2003

(87) PCT Pub. No.: WO02/087767

PCT Pub. Date: Nov. 7, 2002

(65) Prior Publication Data

US 2004/0118957 A1 Jun. 24, 2004

(30) Foreign Application Priority Data

Apr. 27, 2001 (DE) ..... 101 20 765

(51) Int. Cl.
*B02C 18/16* (2006.01)

(52) U.S. Cl. ..... 241/236; 241/294

(58) Field of Classification Search ..... 241/236, 241/293, 294, 295

See application file for complete search history.

(56) References Cited

U.S. PATENT DOCUMENTS

| | | | | |
|---|---|---|---|---|
| 3,240,436 | A | 3/1966 | Mylting | |
| 3,633,831 | A * | 1/1972 | Dodson et al. | 241/61 |
| 3,974,970 | A * | 8/1976 | Bertrand et al. | 241/222 |
| 5,547,136 | A | 8/1996 | Steffens et al. | |

FOREIGN PATENT DOCUMENTS

| | | |
|---|---|---|
| DE | 688 590 | 2/1940 |
| DE | 09136037 | 5/1997 |
| DE | 196 34 639 | 3/1998 |
| EP | 0 167 178 | 1/1986 |
| WO | WO 00/35585 | 6/2000 |

* cited by examiner

*Primary Examiner*—Mark Rosenbaum
(74) *Attorney, Agent, or Firm*—Herbert Dubno

(57) ABSTRACT

The invention relates to a multi-roller crusher for the comminuting of mineral mill-feed, whereby the crushing roll are provided with crushing teeth, extending in the circumferential and longitudinal axial directions. Viewed in plan, the crushing teeth are arranged on each crushing roller such that several serial crushing teeth groups are formed behind each other, the imagined connection lines of which run successively at an inclined angle to the plan (1',2') of each crushing roller outer edge in the direction of the crushing roller centre.

11 Claims, 18 Drawing Sheets

MULTI-ROLLER CRUSHER

CROSS REFERENCE TO RELATED APPLICATIONS

This application is a national stage of PCT/EP02/03666 filed 3 Apr. 2002 and is based upon German national application 101 20 765.4 of 27 Apr. 2001 under the International Convention.

FIELD OF THE INVENTION

The invention relates to a multi-roller crusher for comminuting mineral material to be crushed, the crushing rollers being provided with radially projecting crushing teeth, extending both in the circumferential and longitudinal axial directions.

BACKGROUND OF THE INVENTION

The practically viable methods of comminution differ by is the type of stress or deformation of the particles to be comminuted in the crushing chamber. When stressing the particles between two roller surfaces, pressure, shear and tensile stresses are generated in the particles. The design of the roller surface as well as the rate of rotation determine the type of stress and the intensity.

U.S. Pat. No. 3,240,436 describes a crushing apparatus for solid materials. In this case glass products, such as television tubes or the like are regarded as solid materials.

The counter-rotating crushing rollers are driven synchronously by way of a joint drive mechanism and comprise crushing teeth in the form of annular gears and arranged in the peripheral and longitudinal axial directions. The cross-section through each crushing roller shows a plurality of crushing teeth per annular gear so that in the region where the individual crushing teeth of the two crushing rollers comb with one another relatively small crushing chambers are formed in the entry region above the crushing rollers. It is shown that even relatively large glass products may be gripped by the teeth and are pre-crushed in the course of a first crushing process. As the crushing gap of the counter-rotating crushing rollers further decreases, a second, subsequent comminution is performed.

EP-B 0 167 178 describes a mineral crusher comprising two crushing rollers, each of them equipped with a number of mineral crusher teeth projecting radially from the roller, the teeth on each roller being arranged in groups, extending in peripheral direction, spaced axially along the roller, the groups of teeth extending in peripheral direction being so arranged on a roller that they are positioned between adjoining groups of teeth of the other roller, extending in the peripheral direction and being axially spaced apart from them, so that in the event of counter-rotation of the rollers the teeth of the individual groups pass between two axially spaced teeth in adjoining groups of teeth on the other roller, seizing in the course thereof mineral lumps between one another, effecting the breaking up or crushing of the said lumps. The teeth of each roller are so arranged in relation to one another and are of such size and shape that they define a number of discrete, peripherally spaced, spiral or helical configurations extending along the roller. Each roller includes therefore tooth formations extending spirally from one end to the other, in which context the helix may run in the same or in the opposite direction. The object and purpose of the spiral or helical configuration of the crushing teeth is based on transporting the material to be comminuted in the longitudinal direction of the crushing rollers and in comminuting the former during transport. However, an arrangement of the spiral or helical tooth formation in the same direction would in this case be non-sensical, as no defined transport can be performed. This is only possible when the helices are arranged counter-directionally.

A mineral crusher designed in this manner comprises relatively few teeth per annular gear, viewed in the peripheral direction, so that with counter-rotating rollers a larger crushing chamber is formed already, serving to comminute larger lumps as well. However, it is a drawback of this mineral crusher that the material to be crushed must be fed essentially from the end face side in order to exploit the transport effect, thereby causing various conditions of wear—even when considering the transport of the material in the longitudinal direction of the rollers.

If the material were to be fed elsewhere than at the end, transport would take place, but it would not be optimal and it would be undefined.

The present invention is based upon the state of the art as established by EP 0 167 178, i.e. by a slow running double roller crusher. Such machines are used both for the comminution of medium-hard rock as well as for materials with a tendency to cake, i.e. brown and hard coal, limestone, clay marl and similar raw materials. Parallel and counter-rotating crusher rollers are equipped—as set out in the characterising part of the first patent claim—with crushing teeth, the size, shape and configuration of which define, during the interaction of both rollers, a crushing chamber, ensuring the required quality of the discharge particle size and the throughput performance during comminution.

OBJECTS OF THE INVENTION

It is an object of the invention to optimize the multi-roller crusher described in the PREAMBLE of the first patent claim of EP 0 176 178 in such a manner that, in contrast to EP 0 176 178, due to the formation of simultaneously effective primary crushing chambers substantially more large-grained lumps may also be comminuted parallel and effectively in less time, in order, thereby, to attain an increase of the effective comminution output. Wear should occur uniformly across the length of the roller, with regard to the serviceable life of the multi-roller crusher.

SUMMARY OF THE INVENTION

This object is attained in that when viewing the developed view of each crushing roller in plan view, the crushing teeth are arranged on each crushing roller such that they form a plurality of successive crushing teeth groups, the imaginary connection lines of which, at a presettable angle of inclination in relation to the plan view, extend towards one another from each crushing roller outer edge in the direction of the crushing roller center.

The invention therefore is a comminuting apparatus, whose crushing rollers are equipped with a small number of large tooth formations, viewed over the periphery. The ratio between the outer diameter of the roller and the tooth height should in this case be less than 5:1, in which context the number of teeth, seen in the peripheral direction of each crushing roller, should be small, e.g. limited to nine teeth.

The fewer teeth are present over the periphery, uniformly spaced from the center, and over the outer diameter of the crusher rollers and the lower the peripheral velocity and therefore the tooth engagement frequency, the more aggressively the roller surface acts on the material to be fed, ensuring effective material intake. Because of the small basic diameter of the crushing rollers in relation to the center distance, the tooth height and an axial tooth separation, in the case of this type of crushing chamber design, relatively large free spaces are created between the adjoining and opposite crushing teeth in the region between the crushing rollers. In particular, due to the mutually facing arrow configuration, viewed in the longitudinal direction of the rollers, two successive primary crushing chambers of approximately the same size are formed. The person skilled in the art considers the continuous formation of deep three-dimensional troughs for the entry of large material lumps on the roller surfaces as primary crushing chambers.

The actual comminution process of larger material lumps commences in this case with positive material feeding. The material lumps are seized between two or more corresponding crushing teeth of the crushing rollers and undergo a first size reduction. With further rotation of the crushing rollers the combing of the corresponding teeth formations brings about the formation of secondary crushing chambers, in which the pre-crushed or smaller material is clamped and is locally stressed under bending and shearing action. In this step the comminution is performed between the crushing teeth diameter and the basic diameter of the crushing rollers, or, respectively, between the tooth front and the tooth back of the opposing crushing roller.

To that extent the type of comminution is to be considered analogous to that described in EP 0 167 178. However, in contrast to the state of the art, in the sense of momentary views taken over the length of the roller, large intake regions are brought about either simultaneously one behind the other or continuously forming anew, so that in this case, contrary to the state of the art, a substantially higher portion of coarse material may be pre-crushed, which considerably increases the effective comminution output. In view of the fact that, contrary to the state of the art, material transport is now brought about on both sides, intake of the material to be crushed may now take place centrally from above, i.e. directly into the developing larger crushing regions. Wear of the multi-roller crusher according to the invention, viewed over its length, is substantially more uniform in comparison with the state of the art, which may also increase the useful life.

In addition, subsequent comminution may optionally take place below the central crushing gap in that a crusher beam, known per se is provided, combining the function of an anvil or comb.

Essential factors for effective comminution with high throughput performance by reducing the comminution time for large material lumps are seen in the following points Peripheral velocity Tooth configuration or distribution Tooth arrangement Positioning of rotor In the developed view the successively arranged crushing tooth formations comprise, as imaginary connection lines, straight lines or bends with predeterminable curvature.

However, an essential difference in contrast to the state of the art according to EP 0 17 178 is that for each crushing roller successive mutually facing crushing tooth groups are formed, which ideally, i.e. in the case of a rectilinearly proceeding imaginary connection line, result in arrows oriented towards or away from one another.

The uniform crushing tooth formations over the periphery (annular gear) in the case of the multi-roller crusher according to the invention are arranged axially in relation to one another on a crushing roller at a particular offset-angle, so that, viewed spatially, two counter-oriented tooth rows are formed, which in the event of an uneven number of annular gears have their vertex in the region of the central annular gear of each crushing roller. In the event of an even number of annular gears there exists no central annular gear, so that the vertex will be formed differently. The corresponding opposite crushing roller is equipped with the same tooth arrangement, viewed over its length. In plan view onto the crushing rollers in operation an arrow-like configuration extending in opposite direction thus comes about, subdividing the overall roller length into two large regions of about the same size.

A further development of the invention may provide that the imaginary connection lines of the crushing teeth of each crushing roller are provided in relation to one another appropriately set off in relation to one another. In this particular arrangement the uniform crushing tooth formations are arranged axially in relation to one another on a crushing roller at a particular offset-angle over the periphery (annular gear), such that when viewed spatially, two rows of teeth are formed facing in opposite directions, which, offset by a predeterminable angle of circumferential pitch, extend towards one another. The matching opposite roller is equipped with the same tooth arrangement, viewed over the roller length. In practical use, when viewed in plan view of the crushing rollers, an offset arrow configuration is brought about extending counter-directionally, subdividing the overall roller length into two regions of approximately equal size.

This arrangement differs from the first one mentioned above in that the intake regions developing during operation in the course of combing of the counter-rotating crusher rollers are not formed simultaneously, but successively. By way of this configuration the object of a continuous comminution process/force concentration may even be realized in the case of smaller crushing roller lengths comprising a smaller number of teeth/circumference.

Therefore, in contrast to the state of the art, a continuous formation of a plurality of deep, three-dimensional, primary crushing chambers is brought about for the simultaneous entry of large material lumps.

For the development of primary crushing chambers crushing rollers are advantageous, which rotate approximately synchronously. This is achieved by mechanically coupling the crushing rollers, but has to be regarded as complex, since the crusher housing corresponds to the gear housing. In this context a double or single drive mechanism may be used. In order to realize this approximately synchronous roller rotation without mechanical connection, it is possible to equip both rollers with independent drive means and to provide them, for example, with a master slave control, permitting precise roller timing.

A further parameter for optimizing the primary crushing chamber-design is seen in driving the crushing rollers asynchronously. In this case an independent drive means may be assigned to each crushing roller or a single drive mechanism comprising a mechanical step-down gear unit may likewise be employed. The optimal differential velocity of the crushing rollers for a high incidence of primary crushing space formation may, for example, be controlled or set by a frequency converter or hydraulic motor. The optimal differential velocity depends in this case on the process-technological task to be completed and the number of teeth over the circumference.

Both in the case of the advantageous arrow-shaped configuration as well as in the case of the crushing tooth groups, provided in an offset manner in relation to one another, a distribution function is performed on both sides from the center of the crushing chamber in order to exploit the overall width of the crushing roller by axial force components, especially in the case of larger sized material lumps. The material is fed to the comminution apparatus, controlled by a feeding conveyor, in which context the feed direction may be transverse to the longitudinal direction of the rollers. The point of impact of the discharge parabola may be set between the counter-rotating crushing rollers as target-oriented as possible. This arrangement avoids power- and wear-intensive deflecting and lifting of the material flow. In particular, the fine content in the feed material may be put through directly and with the lowest resistance and dwell time possible, using as large as possible a passage cross-section over the length of the roller.

BRIEF DESCRIPTION OF THE DRAWING

The subject of the invention is shown by way of a working example in the drawing and is described as follows. In the drawing.

SPECIFIC DESCRIPTION

Figure 1:
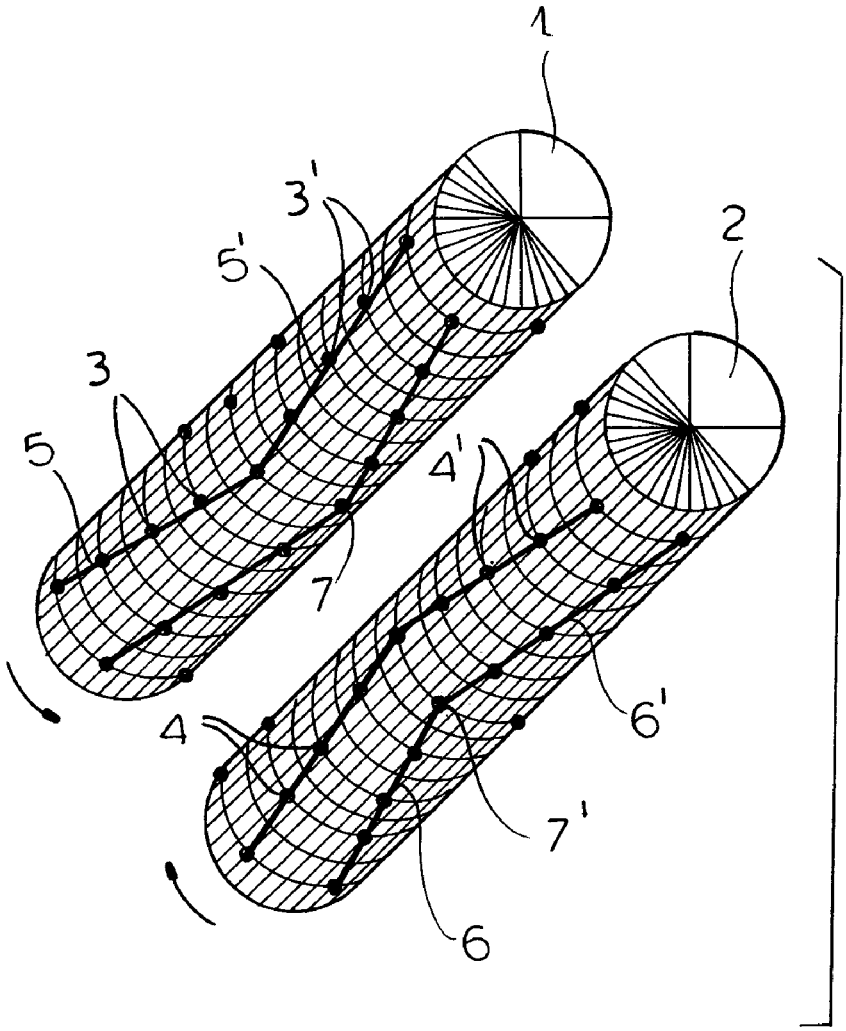
FIGS. 1 and 2 are schematic diagrams of counter-rotating crushing rollers of a multi-roller crusher, not shown in detail, as well as their developed views.
Figure 2:
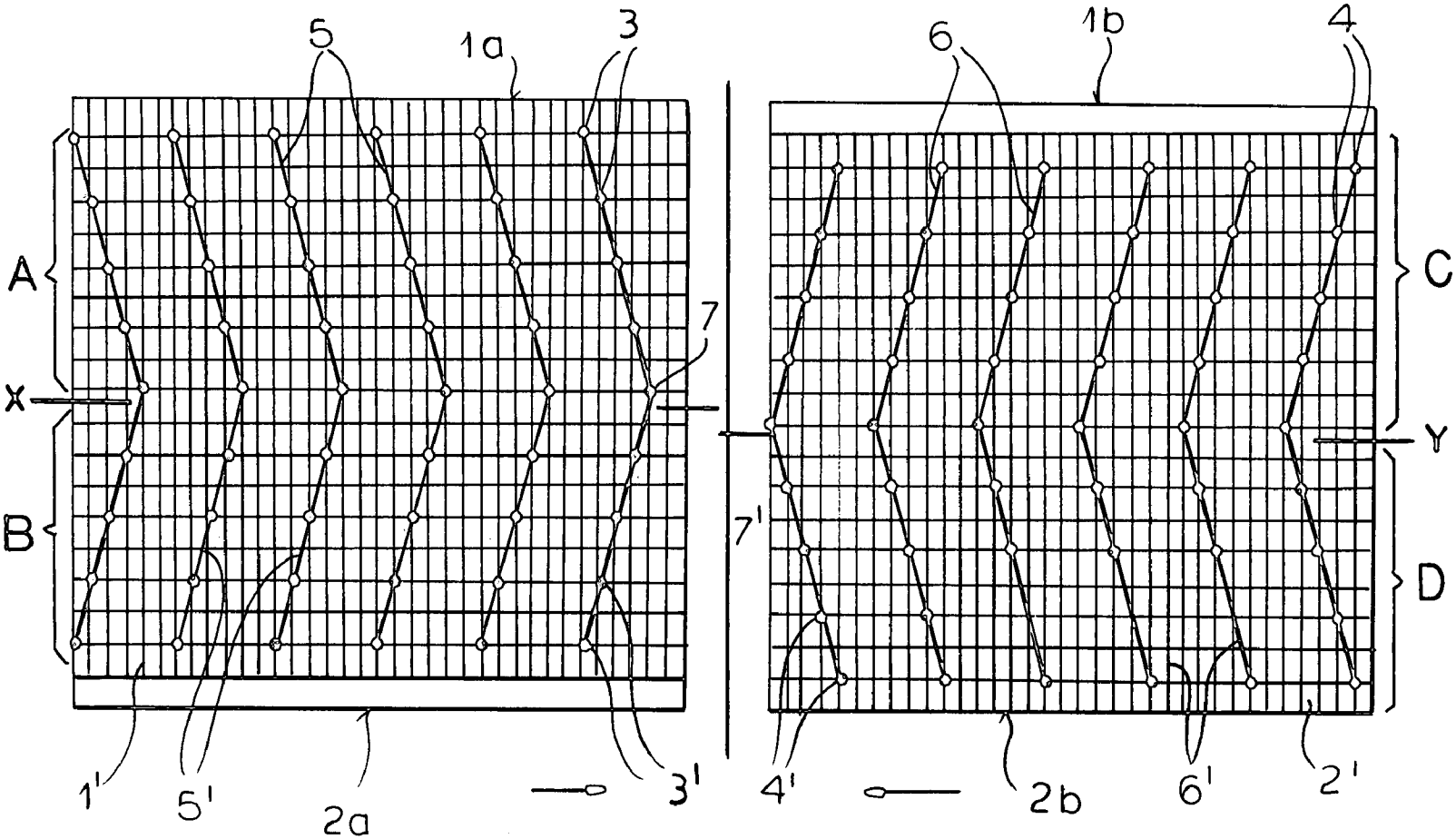

In the form of schematic diagrams FIGS. 1 and 2 show counter-rotating crushing rollers 1,2 of a multi-roller crusher not shown in detail. FIG. 1 shows the crushing rollers 1,2 in their normal state, while FIG. 2 illustrates the crushing rollers 1,2 in their developed view 1',2'. The indicated dots define crushing teeth 3,3',4,4'. It is apparent both from the crushing rollers 1,2 shown in FIG. 1 as well as from their developed view 1',2' that the imaginary lines 5,5',6,6' interconnecting the crushing teeth 3,31,4,41 extend on each crushing roller 1,2 in such a manner that successive arrows are formed. The crushing teeth 3,3',4,4' of each crushing roller 1,2 form crushing tooth groups A,B,C,D, in which case the crushing teeth 3,3',4,4' of each crushing tooth group A,B,C,D extend from the respective outer edge 1*a*,2*a*,1*b*,2*b* of the crushing roller in the direction of the center X-Y of the crushing roller. The uniform crushing tooth formations over the circumference (annular gear) are in this crushing roller arrangement offset axially in relation to one another on the crushing roller 1 at a special offset angle, such that, when viewed spatially, two rows of teeth are formed facing in opposite directions, having their vertex in the region of the central annular gear 7 of the crushing roller 1. The corresponding opposite crushing roller 2 comprises the same tooth arrangement, viewed over the length of the roller, in which case the tooth rows 6,6' (imaginary connection lines) have their vertex in the region of the associated central annular gear 7'. Viewing the crushing rollers 1,2 or their developed views 1',2' in plan view, a counter-directional arrow configuration AB;CD thus forms, dividing the overall roller length into two uniform regions, as shown in more detail in FIGS. 7 to 11. In FIGS. 1 and 2 the arrows formed in this manner are directed towards one another. In the examples the imaginary connection lines 5,5',6,6' are rectilinear, while curved designs of the protection region are likewise included (FIG. 17), without departing from the arrow configuration.

Figure 3:
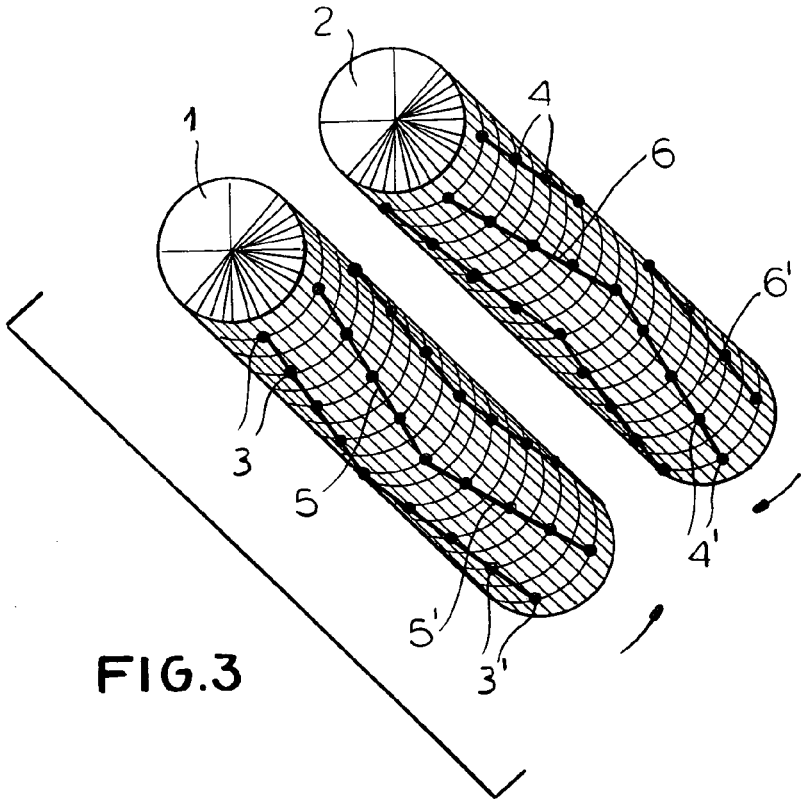
FIGS. 3 and 4 are schematic diagrams of alternative embodiments of crushing rollers as well as their developed views.
Figure 4:
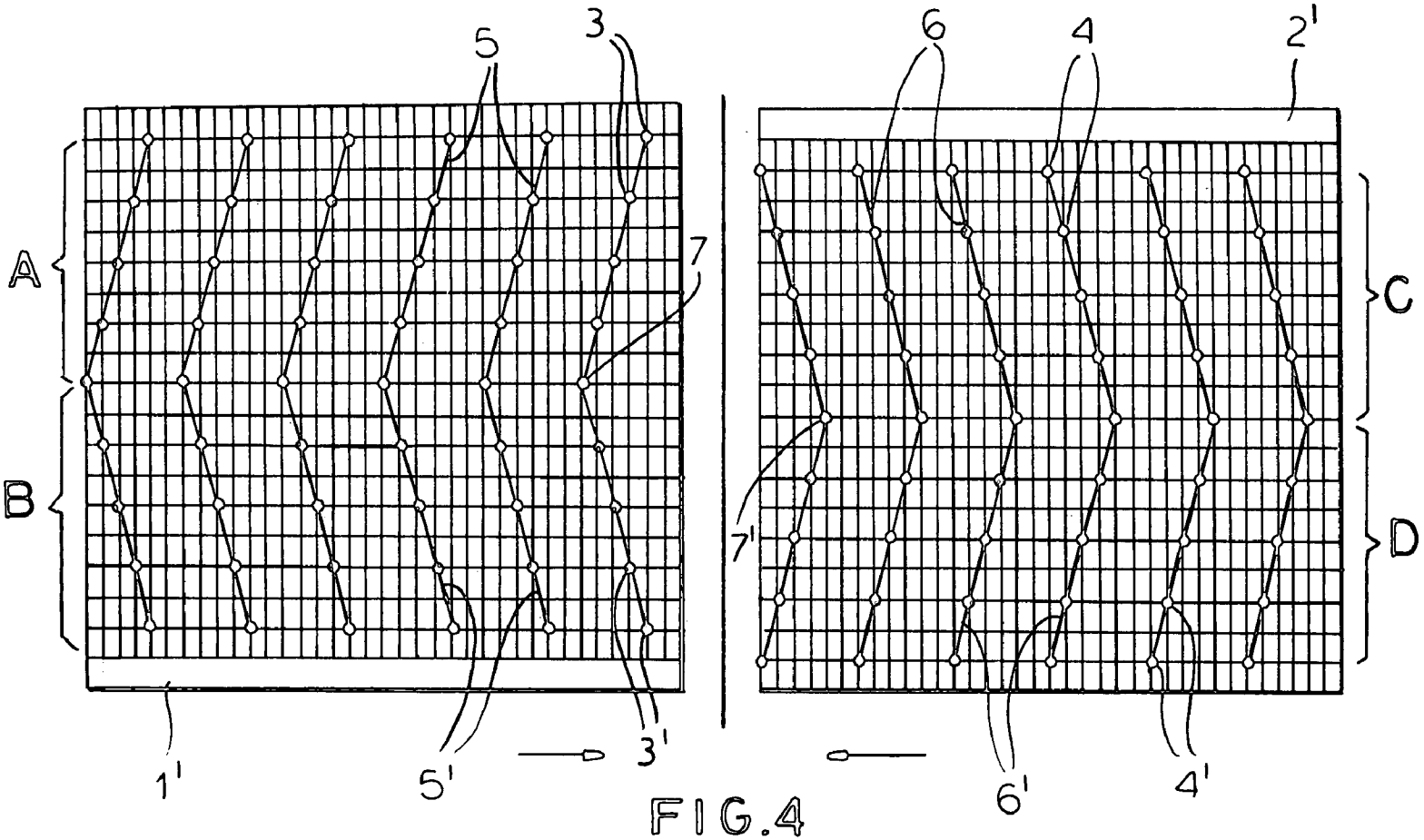

FIGS. 3 and 4 show an alternative to FIGS. 1 and 2, in which case the imaginary connection lines 5,5' as well as 6,6' are likewise so arranged in relation to one another that arrows AB;CD directed away from one another are formed. The uniform arrangement of the crushing teeth 3,3',4,4', viewed over the circumference (annular gear), results in two counter-oriented rows of teeth 5,5',6,6', viewed spatially, having their vertexes in the region of the central annular gear 7,7' of each crushing roller 1,2, or, respectively its developed view 1',2'. For the remainder, the structure of the crushing tooth groups A,B,C,D is be considered analogous to that according to FIGS. 1 and 2.

Figure 5:
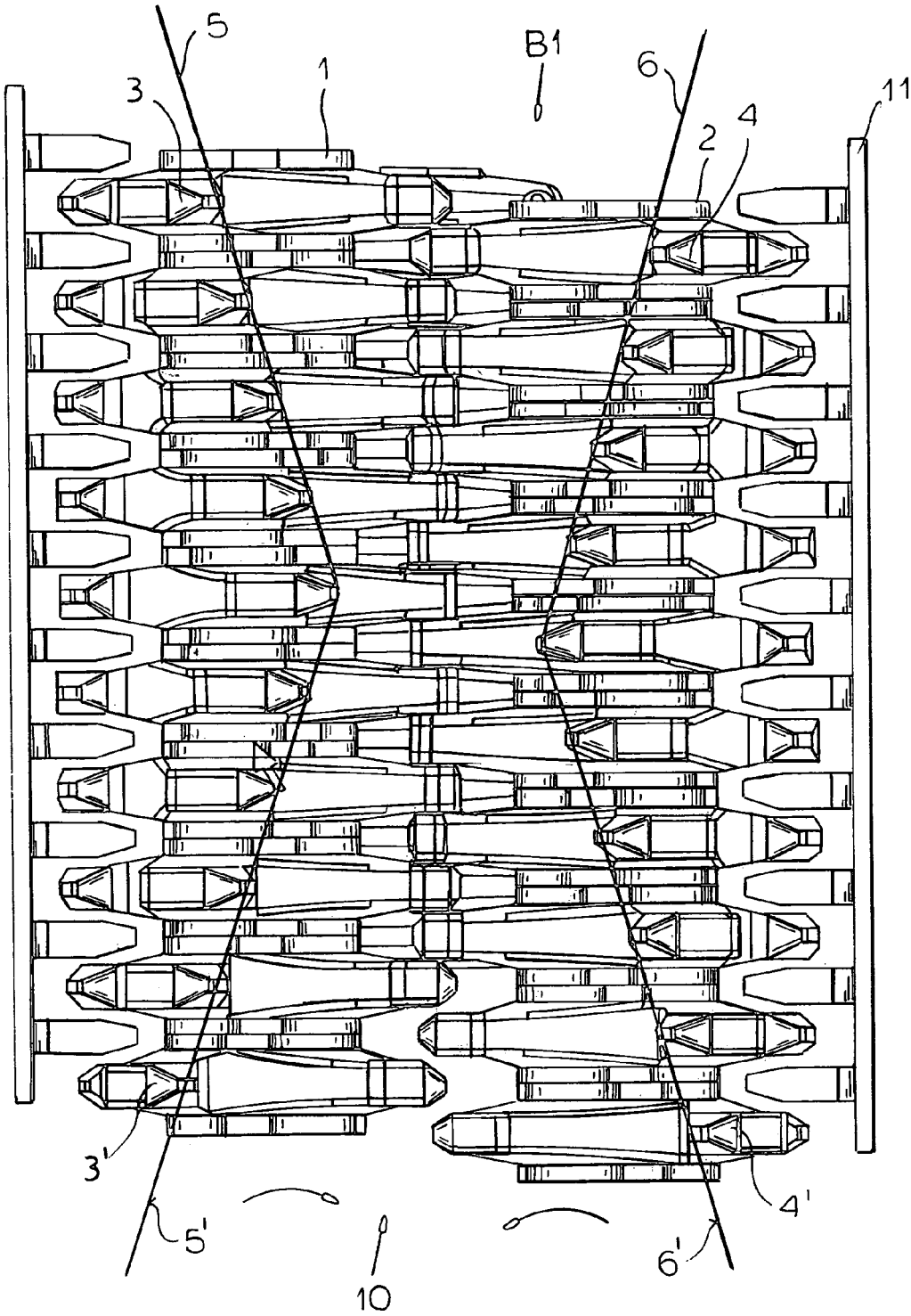
FIG. 5 is a plan view of the installed crushing rollers according to FIGS. 1 and 2.

FIG. 5 shows the plan view of a multi-roller crusher 10 according to FIGS. 1 and 2. Identical components are denoted by identical reference numerals. The crushing rollers 1,2, can be seen housed inside a housing 11. The crushing rollers 1,2 are to be driven in counter-direction to one another (see arrows). Annular gears 12,13 are apparent, to which the crushing teeth 3,4 are replaceably fitted. FIG. 5 is a momentary view of successively positioned, continuously repetitive crushing chambers, in which context in the present example the primary crushing chamber B1 can be seen, formed by the imaginary connection line 5,6 extending along the crushing teeth 3,4.

Figure 6:
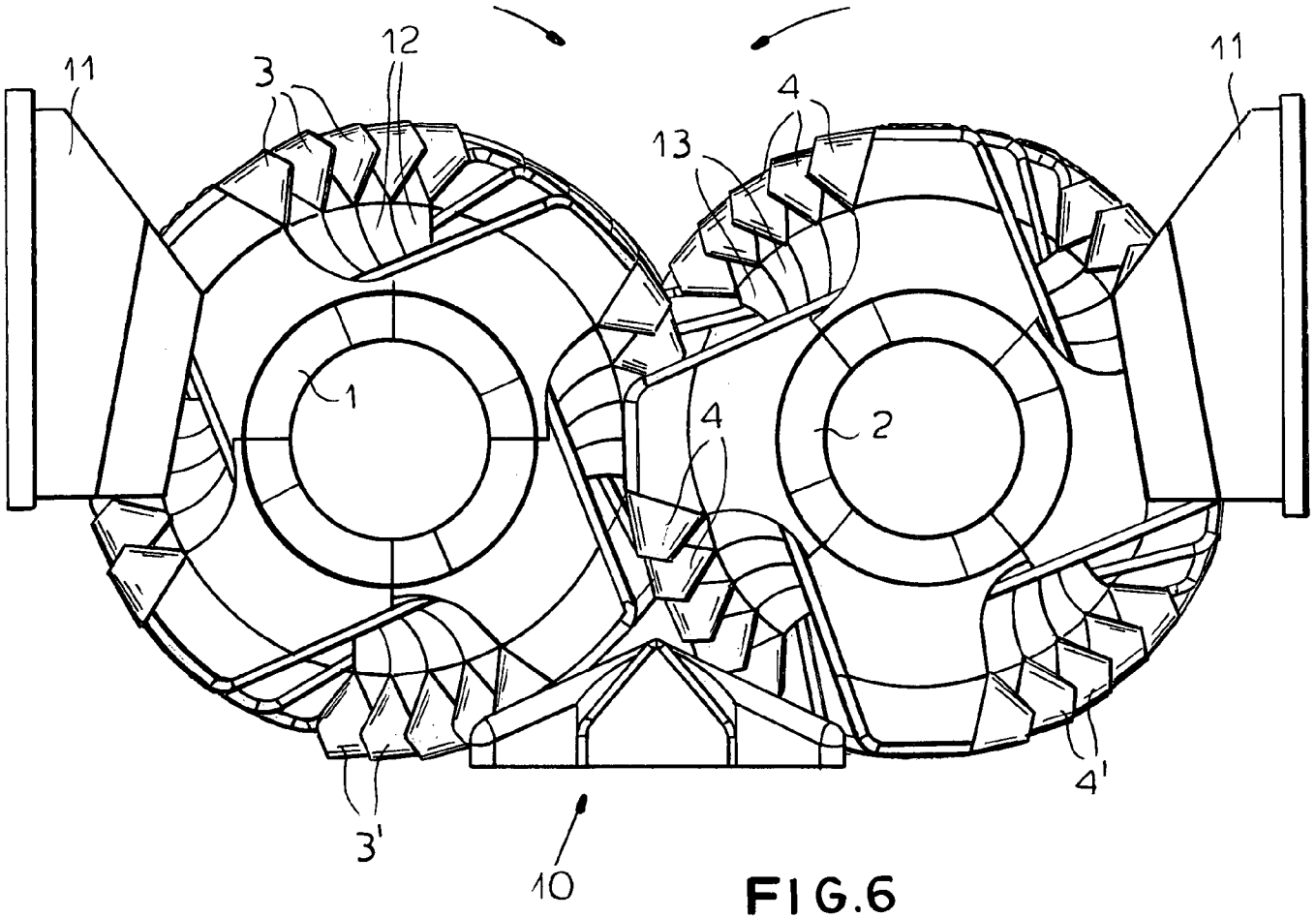
FIG. 6 is a side elevation of the installed crushing rollers according to FIGS. 1 and 2.

FIG. 6 shows a side elevation of the multi-roller crusher 10, where the annular gears 12,13 carrying the crushing teeth 3,4 can be seen with the crushing teeth 3,4, arranged in offset relationship to one another when viewed in the longitudinal direction of the crushing rollers 1,2. Furthermore the housing 11 surrounding the crushing rollers 1,2 can be seen. In the present example, each crushing roller 1,2 comprising 4 crushing teeth 3,4 per annular gear 12,13 so that the arrow-shaped profile shown in FIGS. 1/2; 3/4 is brought about.

Figure 7:
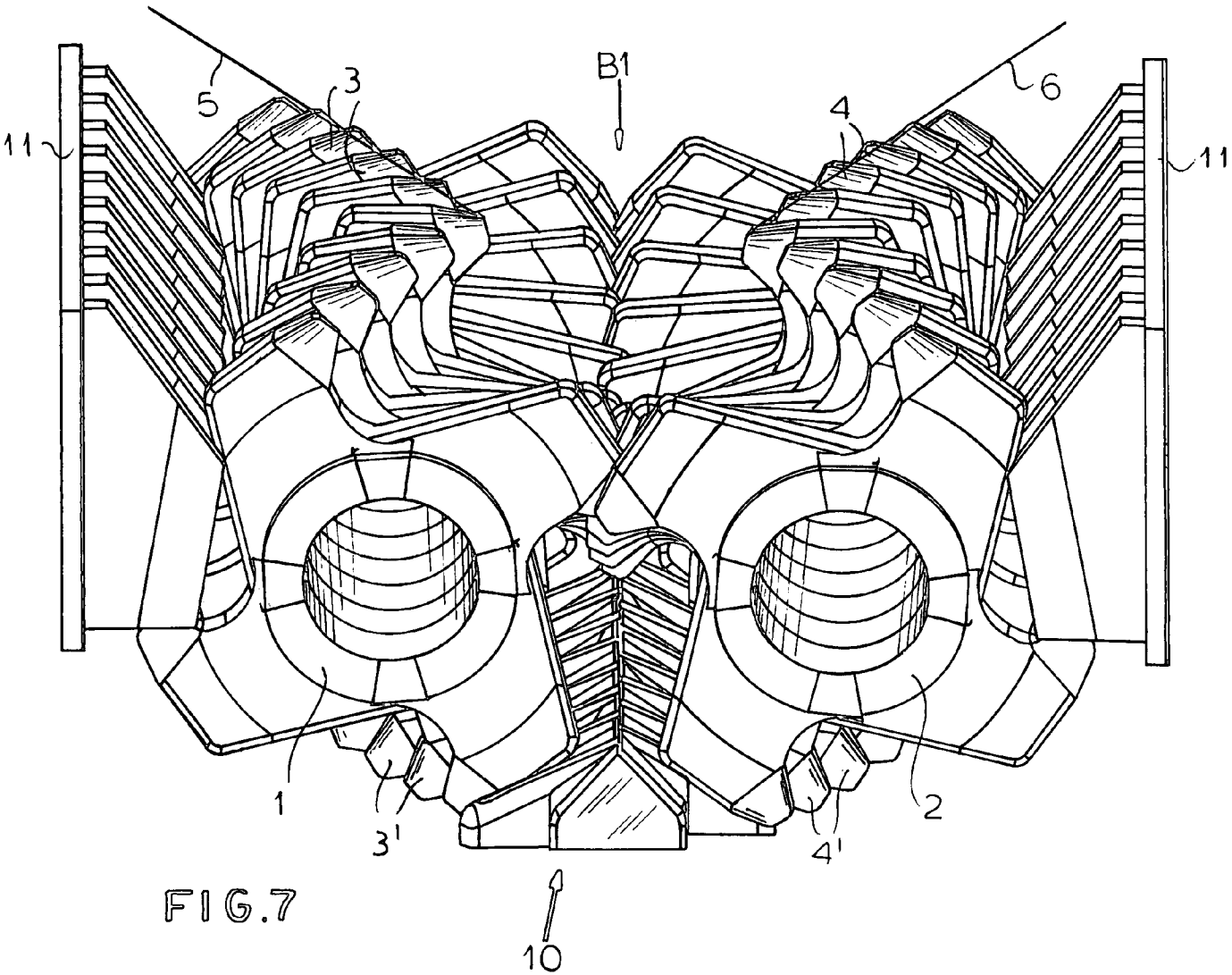
FIGS. 7 to 9 are different spatial illustrations (according to FIGS. 1 and 2) of different momentary views for generating enlarged, successive crushing chamber regions
Figure 8:
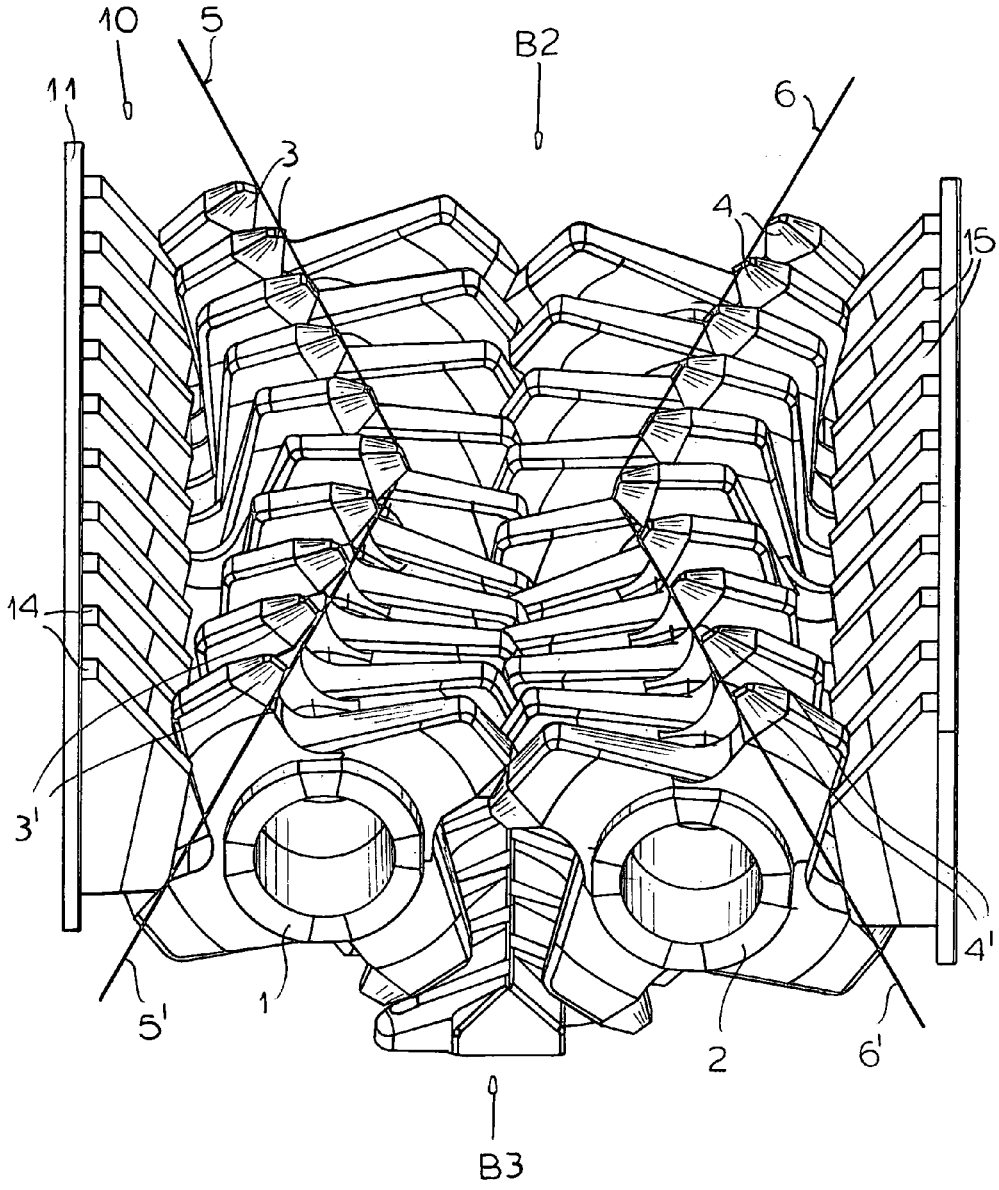
Figure 9:
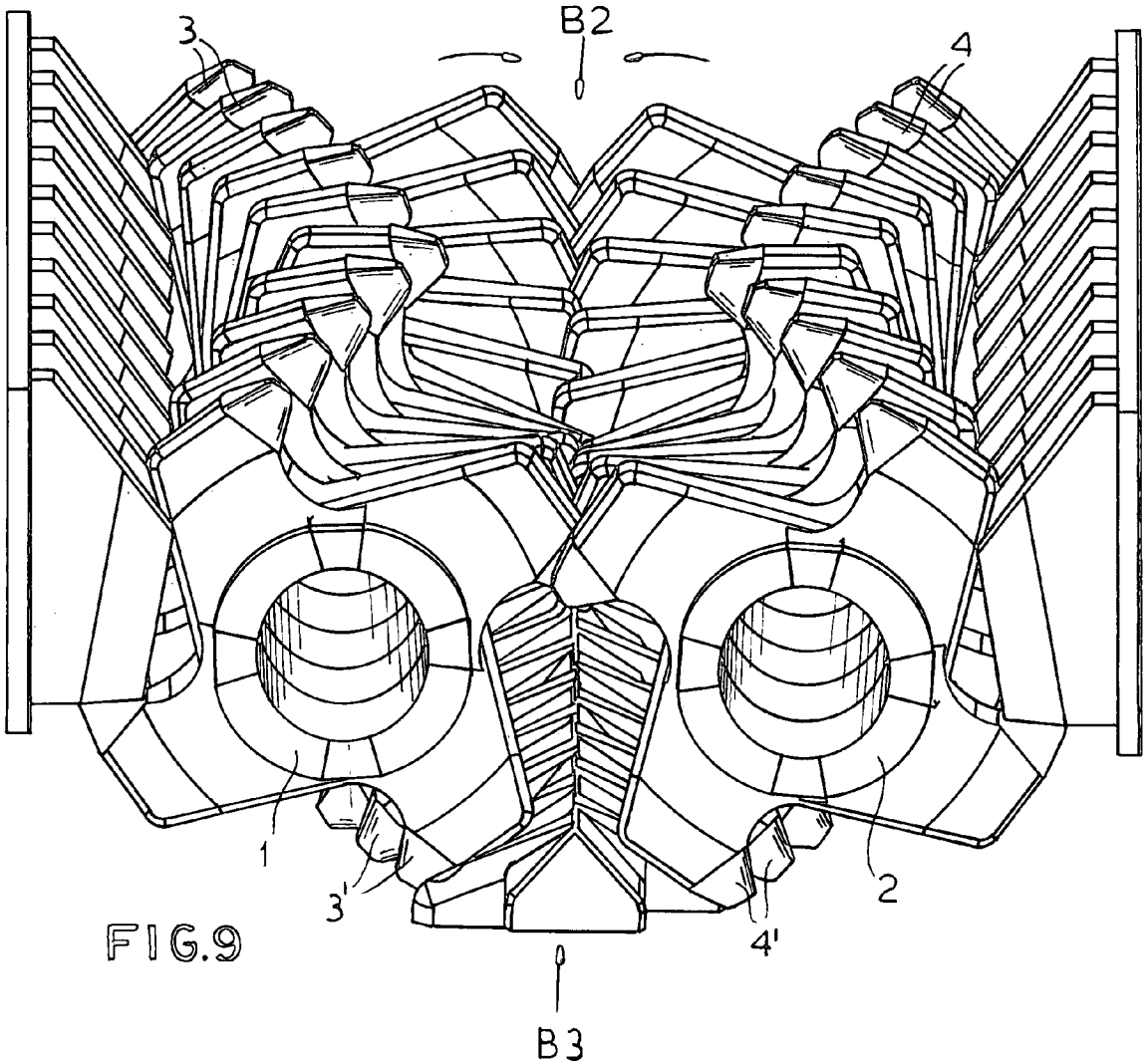

FIGS. 7 to 9 show different perspective illustrations of momentary views of the multi-roller crusher 10 with an arrow-shaped tooth arrangement. This is done with regard to the continuously changing crushing chambers B1, B2, B3. In this case as well, the same reference numerals denote identical components. The two crushing rollers 1,2 are shown, the annular gears 12,13 positioned thereon as well as the crushing teeth 3,3',4,4' provided thereon. The crushing rollers 1,2 are arranged inside the housing 11, in which context the crushing teeth 3,3',4,4' may be passed between formations 14,15 on the side of the casing. The formations 14,15 have a particular configuration and are designed like a comb. It is their function to deflect the material fed to the crushing chamber directly to the central crushing gap, without causing the material to be raised in counter flow. Moreover, they serve as means to avoid oversized particles, since they ensure compliance with the separation size diameter in the side regions. In addition, they exercise a stripping function, in order to protect the space between the annular gears from caking materials. The parameter to be allocated to the crushing spaces B1, B2, B3 is recognizable by way of the imaginary connection lines 5,5',6,6' and illustrates—as already mentioned—merely a momentary view.

FIG. 7 shows an opened-up design of the roller surface, i.e. a deep three-dimensional trough B1 for receiving large material lumps entering there. As a result of the arrow-shaped arrangement of the crushing teeth 3,3',4,4' in conjunction with the given, momentary roller positioning (gripping position) oblong material lumps may come to lie in the trough B1 deepening over the entire roller length towards the center. Because of the rebating on both sides of the corresponding central tooth pair 7,7' of both crushing rollers 1,2 high comminution efficacy is attained. The less mutual interference there is between the adjoining teeth 3,3',4,4' and the tooth pair 7,7', the more favorable is the intake performance. In the state of the art according to EP 0 167 178 a rebating exists only on one side over the roller length of the crushing teeth. In the course of further rotation of the crushing rollers further primary crushing chambers B2, B3 (FIGS. 8 and 9) develop. If the material lump in the primary crushing chamber B1 has not yet been adequately comminuted, it is conveyed into a forced position axially towards the exterior, defined by the respective housing side walls as well as the crushing chambers B1, B2 and the axial force components, exercised by the tooth formations onto the lumps. In these crushing chambers B2, B3 the further primary comminution is performed. In the state of the art only a single primary crushing chamber is formed on the roller surface due to the helical arrangement of the crushing teeth over the roller surface. Any larger sized material lumps remaining at the end of the crushing rollers opposite the end face feeding are therefore merely conveyed into a single forced position, formed by the associated housing side panel. As a result of the frequency of the developing primary crushing chambers B1–B3 the effective primary comminution throughput is substantially increased as compared with the state of the art. The material is transported less until comminution takes place, resulting in faster comminution and lower wear.

Figure 10:
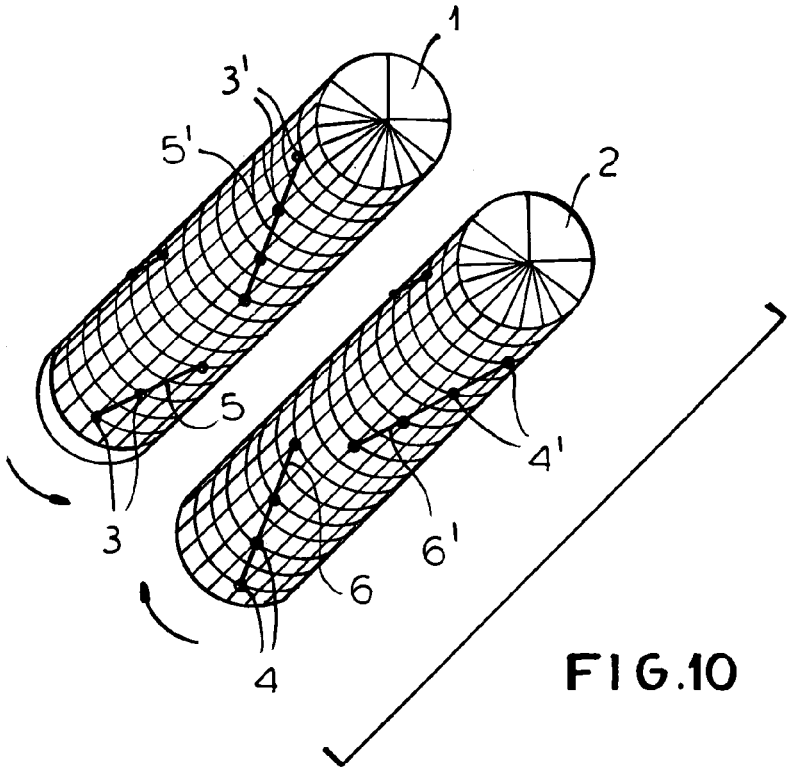
FIGS. 10 and 11 are schematic diagrams of tooth formations on crushing rollers as an alternative to FIGS. 1 to 4.
Figure 11:
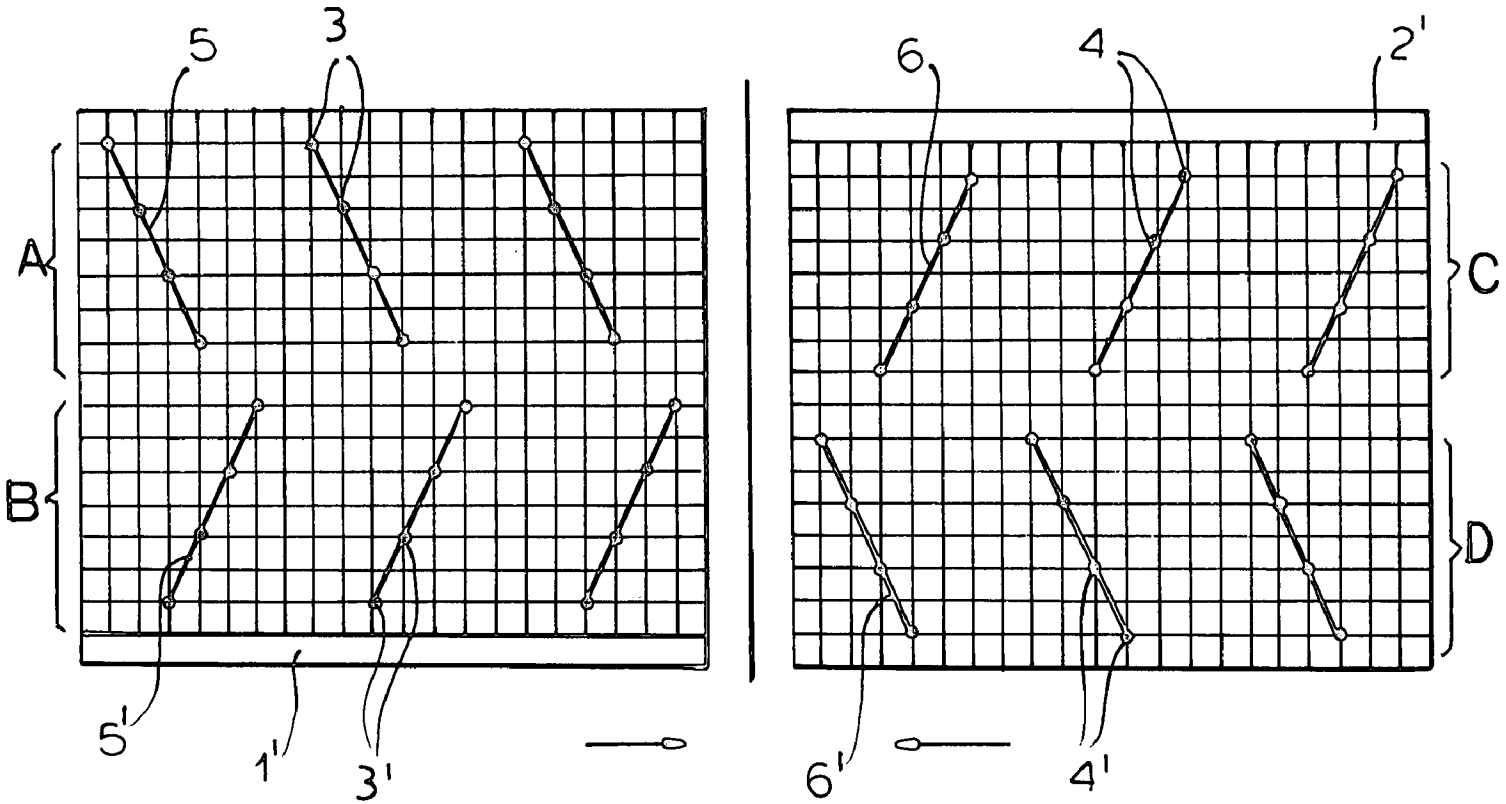

FIGS. 10 and 11, as schematic diagrams, show an alternative embodiment of the tooth groups A,B,C,D in the region of the crushing roller 1,2 as their respective developed views 1',2'. FIG. 11 shows crushing teeth 3,31,4,41 forming successively positioned tooth groups AB;CD, in which case the imaginary connection lines 5,5',6,6' extend towards one another, but do not form an ideal arrow, but an offset arrow configuration. In this example the imaginary connection lines 5,5',6,6' extend towards one another at different angles of inclination. A profile is brought about, which may be compared approximately to that of FIGS. 1 and 2, in which context, as an alternative to FIGS. 3 and 4, a reversed arrangement of the crushing teeth 3,3',4,4' is likewise conceivable.

Figure 12:
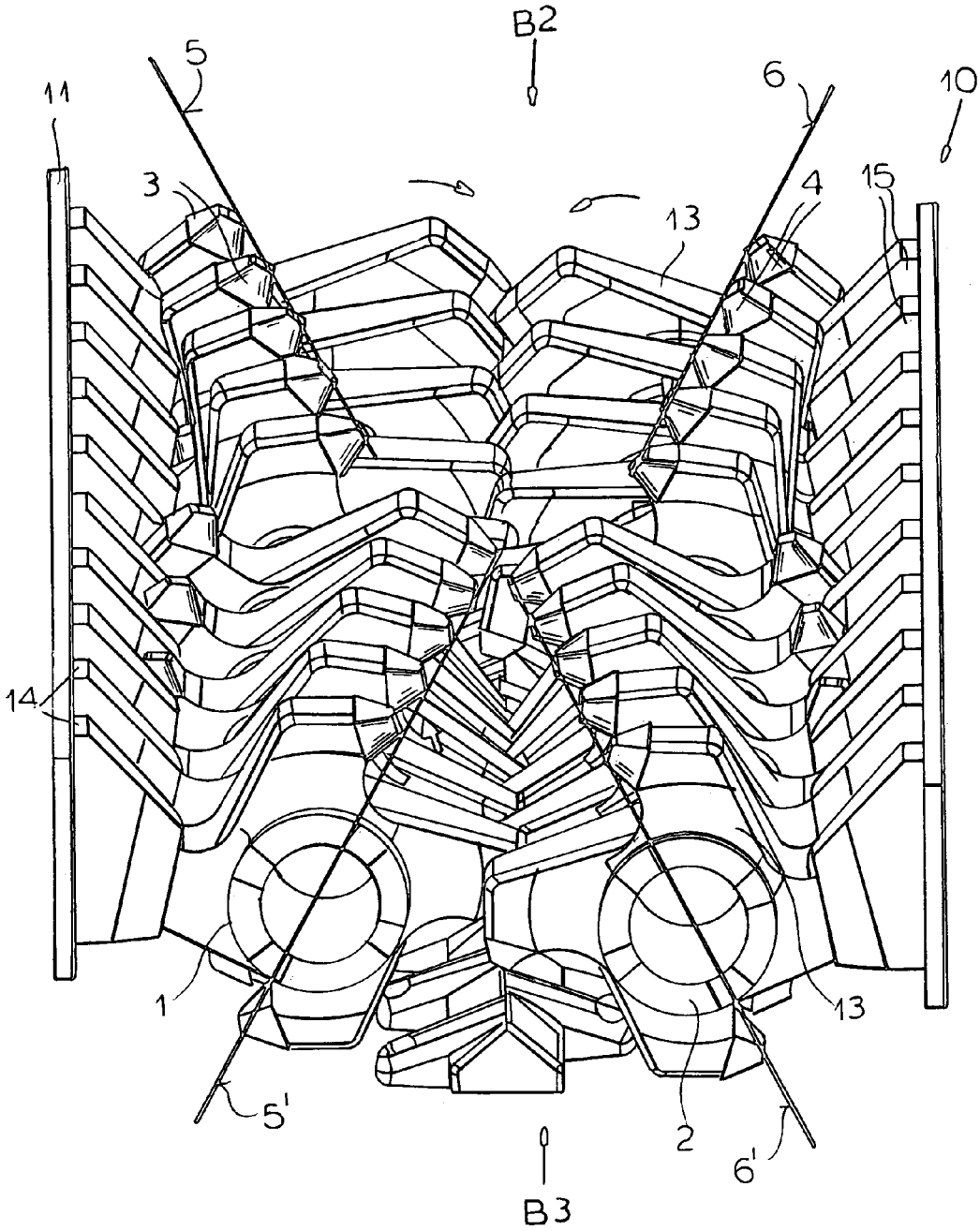
FIGS. 12 to 14 are different spatial illustrations (according to FIGS. 10 and 11) of different momentary view for generating enlarged, successive crushing chamber regions.
Figure 13:
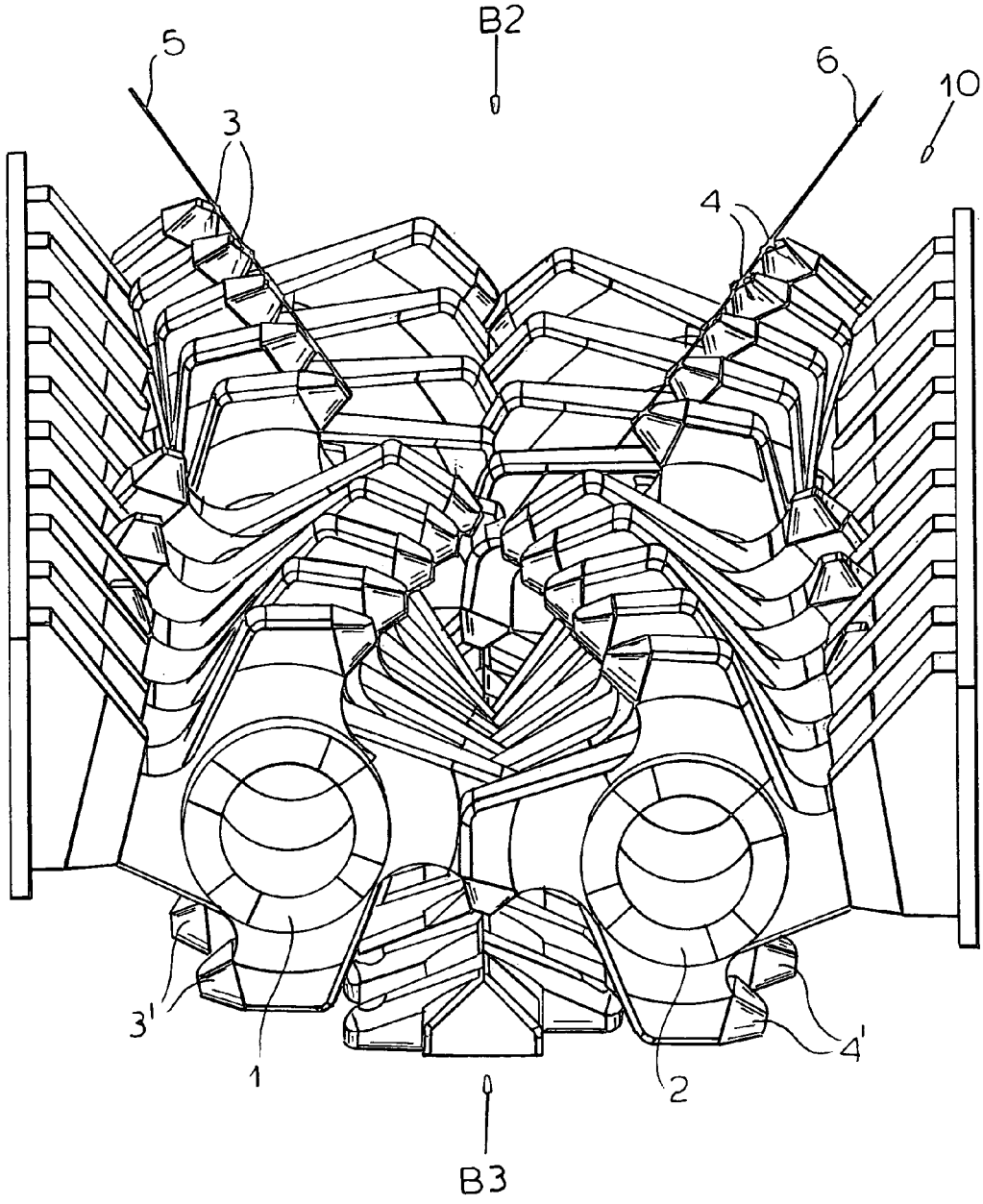
Figure 14:
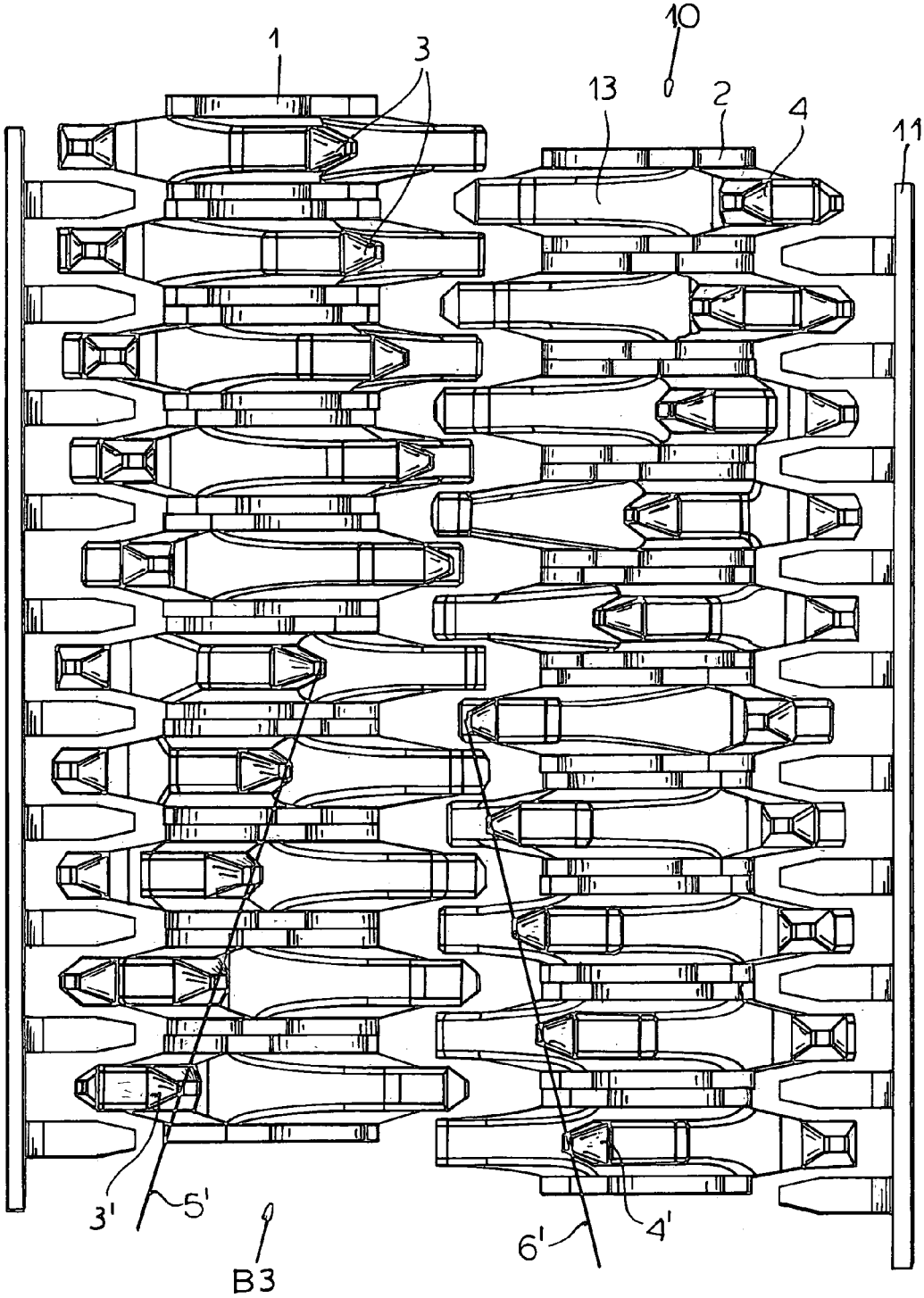

Further momentary views, based on FIGS. 10 and 11, are shown in FIGS. 12–14. The continuous modification of the successively forming crushing chambers B2, B3 is shown, in which context in this case as well identical components are denoted by identical reference numerals.

In the examples cited in accordance with FIGS. 1 to 14 the crushing rollers 1,2 are to be driven synchronously, in which case each crushing roller 1,2 is provided with connected drive means, not shown in detail, such as, for example, gear mechanisms, belts or the like.

Figure 15:
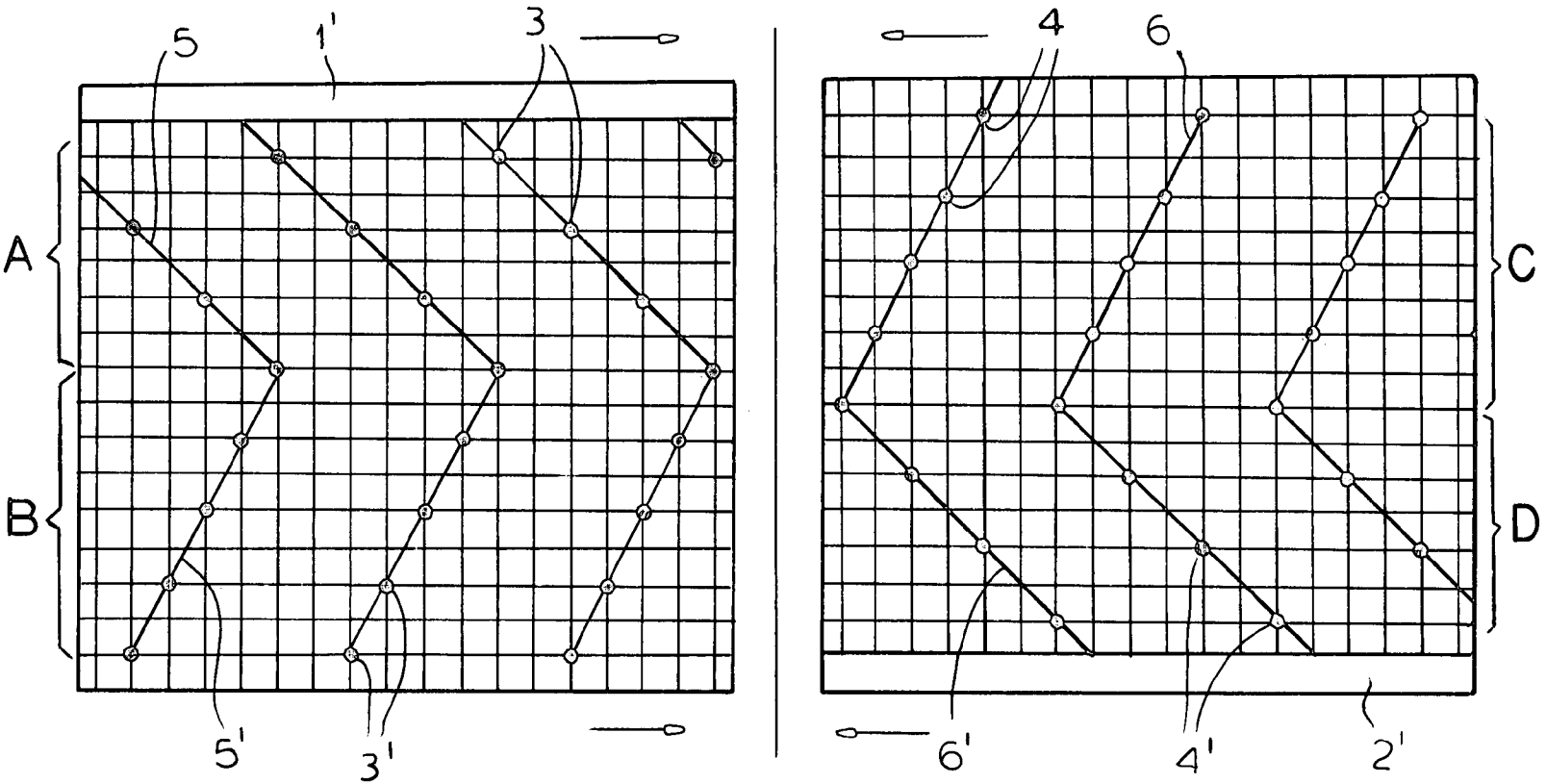
FIG. 15 is the developed view of an arrow-shaped tooth formation with an even number of annular gears and different pitches.

FIG. 15 shows the developed view 1',2' of an arrow-shaped tooth formation with an even number of annular gears and different pitches or angles of inclination of the imaginary connection lines 5,5',6,6' of the individual crushing teeth groups AB, CD. Except for the different pitches of the lines 5,5',6,6' interconnecting the crushing teeth 3,3',4,4', this illustration corresponds approximately to that of FIG. 2.

Figure 16:
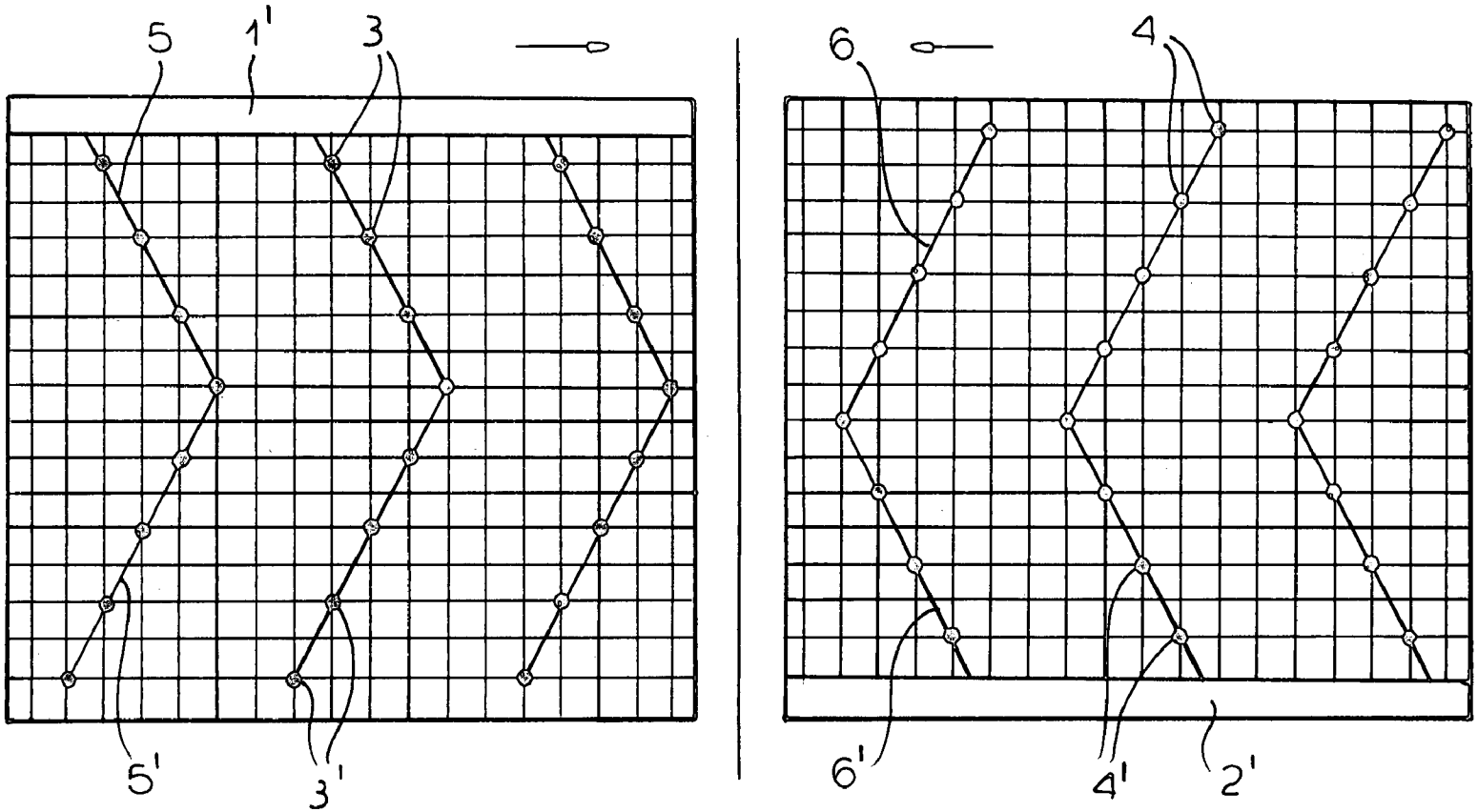
FIG. 16 is the developed view of an arrow-shaped tooth formation with an even number of annular gears and even pitch.

FIG. 16 shows the developed view 1',2' of an arrow-shaped tooth arrangement with an even number of annular gears and even pitches or angles of inclination of the imaginary connection lines 5,5',6,6' and corresponds approximately to that according to FIG. 2.

Figure 17:
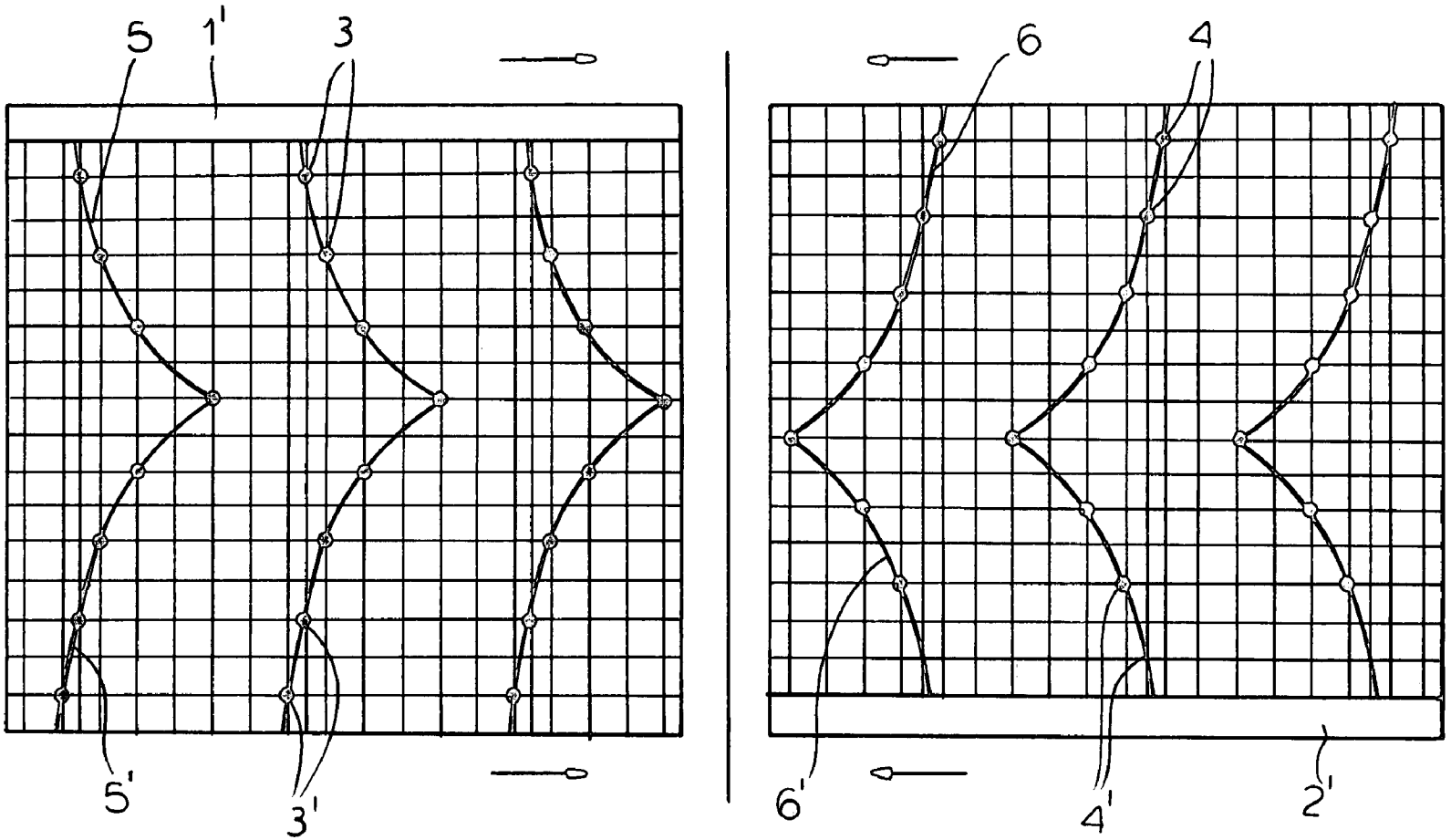
FIG. 17 is the developed view of a curve-like tooth formation.

FIG. 17 shows the developed view 1',2' of the crushing teeth 3,31,4,41 arranged on a curve segment (imaginary connection line 5,5',6,6') as an alternative to FIGS. 2,4,15 and 16.

The person skilled in the art will select the type and arrangement of the crushing teeth 3,3',4,4' on the crushing rollers 1,2 as a function of the respective application.

Figure 18:
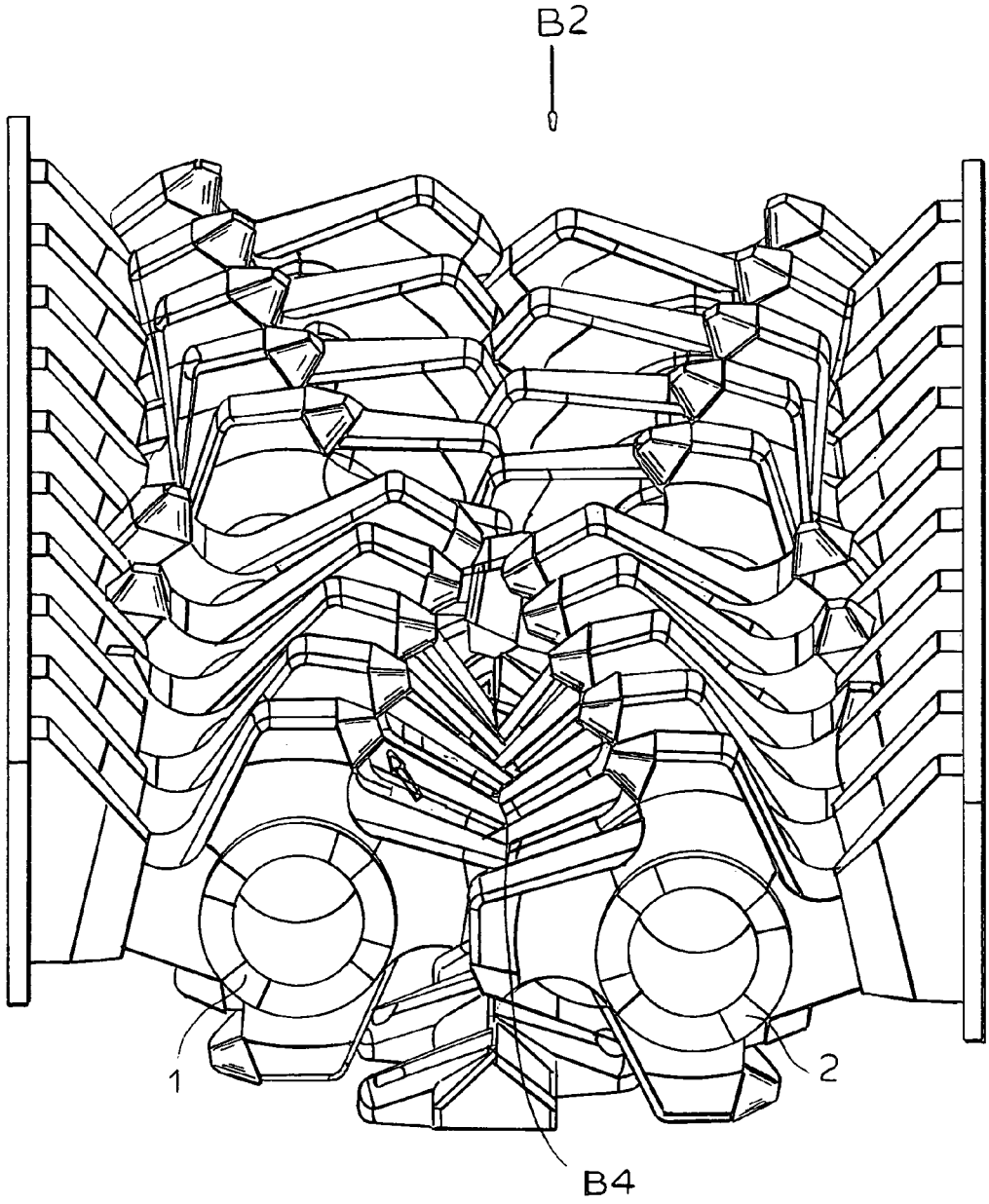
FIGS. 18 and 19 are momentary views during asynchronous operation of the crushing rollers forming primary and secondary crushing spaces.
Figure 19:
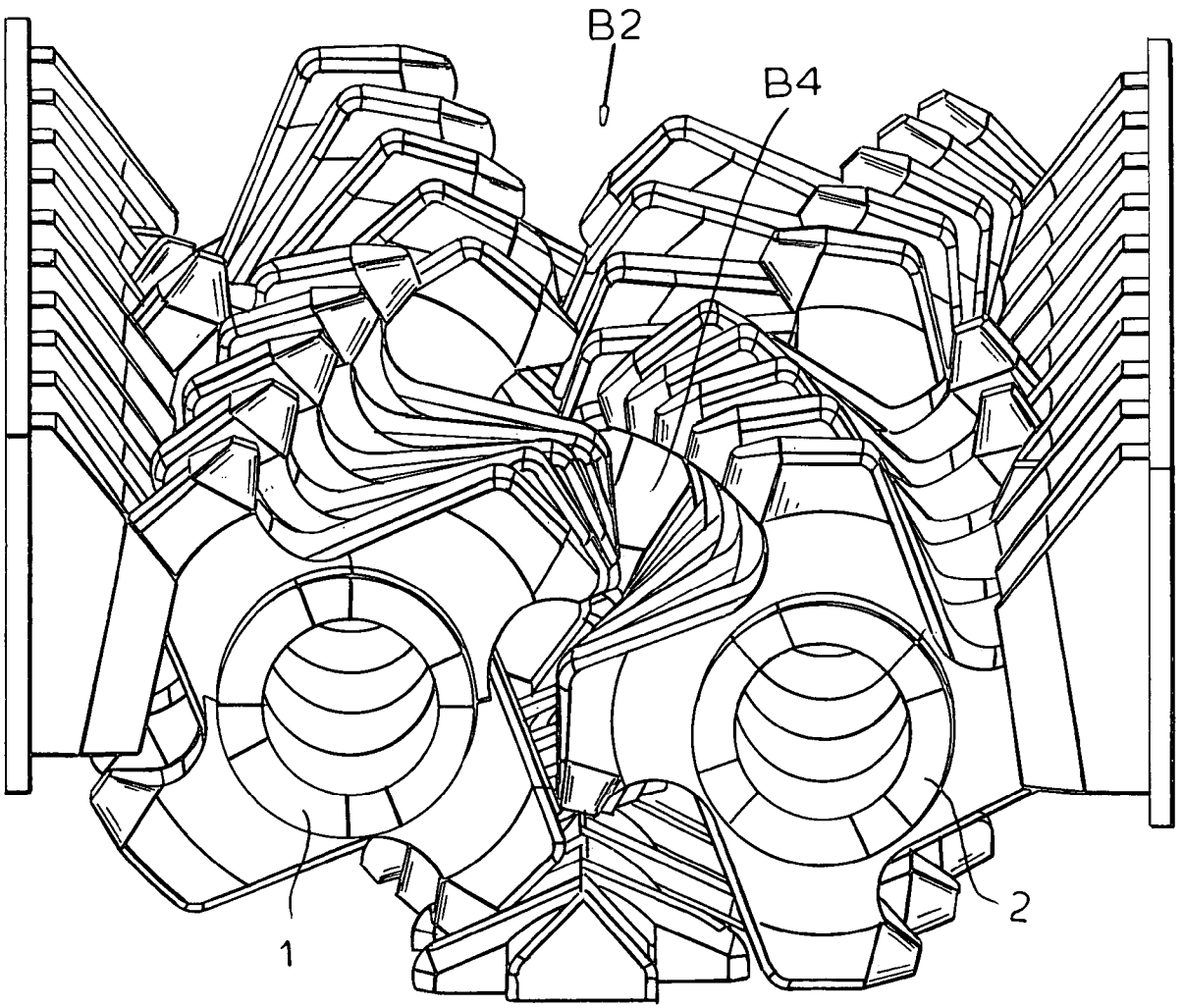

FIGS. 18 and 19 are momentary views during an asynchronous operation of the crushing rollers 1,2. In this example, the crushing rollers 1,2 dispose of independent drive means, such as gears, not shown in detail. Setting of the differential velocity of the two crushing rollers 1,2 may, for example, be regulated by a frequency converter. The primary crushing chamber B2 can be seen. Further indicated is in each case a secondary crushing chamber B4, developing in the narrowing crushing gap of the counter-rotating crushing rollers 1,2 in the course of the further intake of the pre-crushed material. As a result of the alternative arrangement according to the invention of crushing teeth 3,3',4,4' in the selected configurations, the following technical advantages are attained:

Undelayed material intake of relatively large material lumps is performed by the permanent, continuous provision of one or more intake possibilities BI,B2,B3, viewed over the entire length of the crushing rollers 1,2.

Because of the continuously closing, narrowing crushing chambers B1,B2,B3 the material, in the course of combing of the counter-rotating crushing rollers 1,2 is stressed locally in respect of bending and shearing as a result of the introduction of forces via the crushing teeth 3,3',4,4' and not compressively.

A uniformly progressing comminution is attained in the maximally three stress zones (primary, secondary, and, where applicable, tertiary comminution), resulting in a division of the crushing roller length into regions, in which, viewed in the peripheral direction, the primary (B1–B3), secondary (B4) and, optionally, tertiary comminution is performed. There are no dividing lines between the transition points in this case. As the greatest crushing forces occur during the primary size reduction, the installed provision for torque for comminution may be lower, since there is a concentration of forces onto few, operating tooth pairs 3,4;3',4'. The stress on all machine elements, in particular the drive mechanism, is lessened and with lower impact load. The overall stress dynamics are rendered more even.

As a result of the particular crushing roller design and the additional comminution by utilizing a crushing comb in conjunction with the stress on materials resulting there-from, the gap width being the defined smallest spacing of the roller surfaces as well as of the tooth spacings to one another may be substantially greater than in conventional roller crushers, in order to ensure the desired end particle size.

Material transport on the crushing rollers, i.e. bringing about axial force components on the material, in particular large material lumps, in order to avoid grooving and, consequently, jamming of large material lumps. The material remains in motion at all times until a suitable intake and roller position comes about.

Depending on the crushing chamber design B1,B2,B3, determined by the roller design including the tooth configuration and number over the circumference, arrangement, rotor position or use of a crusher beam, the particle size distribution of the final particle may be set.

As a result of the tooth arrangement according to the invention, contemplated in momentary views, a continuous formation of deep three-dimensional, primary crushing chambers BI,B2,B3 for the penetration of large material lumps takes place. Because of the arrow-shaped or arrow-like configuration in conjunction with—if required—a synchronised crusher roller positioning in gripping position, the simultaneous (or successive) formation of intake regions B1,B2,B3 on the roller surface is brought about. In particular, the efficiency of the corresponding central tooth pair 7,7' of both crushing rollers 1,2 is improved, as oblong material lumps may come to lie in the recess(es) BI,B2,B3 deepening over the entire crushing roller length towards the centre. The axial offset angle of the annular gears 12,13 determines the pitch of the counter-oriented imaginary connection lines 5,5',6,6' and is matched to the distribution on the periphery, i.e. number of crushing teeth 3,3',4,4'. An arrangement is optimal, which proceeds continuously, i.e. after passing through the first arrow the central tooth pair 7,7' engages as start of the next following arrow, in order to ensure a continuous crushing operation. The arrow configuration, offset in opposite direction, described in FIGS. 10 and 11 differs from the arrow configurations discussed in FIGS. 1 to 4 in such a manner that the developing intake regions B2, B3 are not formed simultaneously during combing of the counter-rotating crushing rollers 1,2, but successively, i.e. once the one roller half has passed through the primary intake region B2, the primary engagement of the other roller half takes place continuously. With this design the object of a continuous comminution process/force concentration may even be realised in the case of short roller lengths having a low number of teeth in relation to the circumference. As a result of the serial succession of effects, the pitch of the imaginary connection lines 5,5',6,6' may be reduced by half, as compared to the arrangement illustrated in FIGS. 1 to 4. This permits the provision of larger intake chambers B2,B3.

Both arrangements necessitate a distribution function to both sides from the centre of the crushing chamber in order to exploit the entire roller width by axial force components, especially in the case of relatively large material lumps. The material is fed to the multi-roller crusher, controlled normally via a feed conveyor, in which context the feed direction may be transverse to the longitudinal direction of the roller. The point of impact of the discharge parabola may be set between the counter-rotating crushing rollers 1,2 as target-oriented as possible. This arrangement avoids power- and wear-intensive deflecting of the material flow, while, in particular, the fines content in the feed material may be put through directly and with the lowest resistance and dwell time possible, using as large as possible a passage cross-section over the length of the roller.

The invention claimed is:

1. A multi-roller crusher for comminuting mineral material to be crushed comprising two juxtaposed counter rotating crushing rollers receiving lumps of mineral material to be crushed between them, the crushing rollers being provided with radially projecting individual and discrete crushing teeth spaced apart both in a peripheral direction and in a circumferential and longitudinal axial, direction in a developed view of each crushing roller in plan view, the crushing teeth are so arranged that they form a plurality of successive crushing tooth groups, whose imaginary connection lines at a presettable angle of inclination in relation to the developed view, extend towards one another from a respective outer edge of the crushing roller in the direction of a crushing roller center, the adjoining and opposite crushing teeth of the crushing tooth groups defining in an intake region between the counter-rotating crushing rollers continuously repetitive, primary crushing chambers, the imaginary connection lines of the crushing tooth groups of each crushing roller, in relation to the developed view being so oriented towards one another that arrows are formed, which are oriented towards one another.

2. The multi-roller crusher according to claim 1, wherein the imaginary connection lines of the individual crushing tooth groups are straight lines.

3. The multi-roller crusher according to claim 1, wherein the imaginary connection lines of the individual crushing tooth groups are curves with presettable curvature.

4. The multi-roller crusher according to claim 1 wherein the individual crushing tooth groups of each crushing roller are arranged essentially in mirror-image in relation to one another.

5. The multi-roller crusher according to claim 1 wherein the imaginary connection lines of the individual crushing tooth groups extend toward one another at unequal angles of inclination.

6. The multi-roller crusher according to claim 1 wherein the ratio between the outer roller diameter and the tooth height is 5:1, the number of teeth in the peripheral direction of each crushing roller (1, 2) being between four and nine teeth.

7. The multi-roller crusher according to claim 1 wherein the crushing rollers are driven synchronously by a drive mechanism.

8. The multi-roller crusher according to claim 1 wherein one of said crushing rollers is provided to serve as a master roller, while the other crushing roller for approximate synchronization or crushing roller positioning is subjected to a control system for fine adjustment in relation to said one crushing roller.

9. The multi-roller crusher according to claim 1 wherein the crushing rollers are driven asynchronously in order to attain an optimal differential velocity.

10. The multi-roller crusher according to claim 9 independent drives are assigned to each crushing roller.

11. The multi-roller crusher, defined in claim 9 wherein the differential velocity of the crushing rollers is controlled or adjusted by at least one frequency converter, a hydraulic drive or a mechanical step-down gear unit.

* * * * *